US007212092B2

(12) United States Patent
Nuebel et al.

(10) Patent No.: US 7,212,092 B2
(45) Date of Patent: May 1, 2007

(54) DEVICE FOR ENERGY STORAGE AND ENERGY TRANSFORMATION

(75) Inventors: Karl-Heinz Nuebel, Simmozheim (DE); Michael Juhas, Waltenhofen (DE); Markus Weimert, Immenstadt (DE); Tim Skowronek, Lauben (DE)

(73) Assignee: Robert Bosch GmbH, Stuttgart (DE)

( * ) Notice: Subject to any disclaimer, the term of this patent is extended or adjusted under 35 U.S.C. 154(b) by 222 days.

(21) Appl. No.: 10/789,339

(22) Filed: Feb. 26, 2004

(65) Prior Publication Data

US 2004/0217841 A1 Nov. 4, 2004

(30) Foreign Application Priority Data

Feb. 26, 2003 (DE) ..... 103 08 077

(51) Int. Cl.
*H01F 27/02* (2006.01)

(52) U.S. Cl. ..... 336/83; 336/110

(58) Field of Classification Search ..... 336/83, 336/90–96, 178, 212, 234; 123/634–635; 331/110

See application file for complete search history.

(56) References Cited

U.S. PATENT DOCUMENTS 3,209,295 A 9/1965 Baermann
4,658,799 A * 4/1987 Kusaka et al. ..... 123/622
4,990,881 A 2/1991 Ooyabu
5,335,642 A * 8/1994 Hancock et al. ..... 123/634
5,685,065 A * 11/1997 Suzuki et al. ..... 29/606
2002/0171524 A1 11/2002 Tsai

FOREIGN PATENT DOCUMENTS

| | | |
|---|---|---|
| DE | 1 929 566 | 6/1969 |
| DE | 3243432 | 5/1984 |
| DE | 19702438 | 8/1998 |
| GB | 199879 | 7/1928 |
| JP | 2002-359129 | 12/2002 |

* cited by examiner

*Primary Examiner*—Tuyen T. Nguyen
(74) *Attorney, Agent, or Firm*—Kenyon & Kenyon LLP

(57) ABSTRACT

A device for energy storage and energy transformation is described, in particular an ignition coil of an ignition system of a motor vehicle, having a magnetically active I core, which is surrounded by a first coil former having a winding connected to a supply voltage, and a second coil former having a winding connected to a high-voltage terminal, and having a peripheral core forming a magnetic circuit with the I core and enclosing the system made up of the first and second coil formers. In its circumferential extension, the peripheral core has a recess to accommodate an end area of the I core.

12 Claims, 2 Drawing Sheets

DEVICE FOR ENERGY STORAGE AND ENERGY TRANSFORMATION

FIELD OF THE INVENTION

The present invention relates to a device for energy storage and energy transformation, in particular an ignition coil of an ignition system of a motor vehicle.

BACKGROUND INFORMATION

Devices for energy storage and energy transformation are known in the practice in particular as ignition coils, which represent an energy-transmitting high-voltage source and in engines operating according to the spark ignition principle, are used to activate a spark plug, which in turn ignites the fuel mixture in the combustion chamber of the internal combustion engine. In such an energy storage device and transformer embodied as an ignition coil, comparatively low supply voltage electrical energy, normally from a direct current vehicle electrical system, is converted into high-voltage electrical energy at a desired point in time at which an ignition pulse is to be delivered to the spark plug.

To convert electrical energy into magnetic energy, the system current of the motor vehicle flows through a first coil, which is customarily a copper wire winding, as a result of which a magnetic field forms around this coil, the magnetic field having a specific direction and being a closed-line magnetic field. To deliver the stored electrical energy in the form of high-voltage pulses, the previously built-up magnetic field is forced to change its direction by cutting off the electric current, causing an electrical high voltage to be formed in a second coil, which is located physically close to the first coil and has a much higher number of turns. The conversion of the now electrical energy at the spark plug causes the previously built-up magnetic field to break down and the ignition coil to discharge. The design of the second winding makes it possible to set high voltage, spark current and spark duration in the ignition of the internal combustion engine as needed.

Extremely varied designs of ignition coils are known from the related art, which are adapted to the particular use. It is thus possible to design the ignition coil as a pencil coil, for example, as is known from German Patent No. 197 02 438, for example, the length of the coil in this case being large compared to its diameter. Likewise, however, the ignition coil may also be in the form of a compact ignition coil, the length of which essentially corresponds to its width.

All ignition coils have an I core made of a ferromagnetic material such as iron, for example. The I core is thus a rod-shaped or rectangular iron core, the cross-section of which may be made up of lamellae of soft iron sheet, as described, for example in German Patent No. 32 43 432.

In the known related art, the placement of the coils and of the I core is subject to great variation; however, the coils are usually superposed radially and are positioned concentrically to the I core.

It is also customary in practice to provide, in addition to an I core of this type, a peripheral core made of ferromagnetic material, which surrounds the longitudinal extent of the coils and is also described as an "O core" or "ferromagnetic circuit." In order to reduce losses when building up and breaking down the magnetic field, this peripheral core is also normally a combination of layered iron lamellae.

In order to be able to install the windings or coils, the I core and the peripheral core of a ferromagnetic circuit may not be of one piece but instead must be assembled from different component parts. A typical configuration is the construction of an I core and an O core forming a closed O, the I core together with the windings surrounding it being inserted into the interior of the O core at the time the ignition coil is assembled so that the lamella stacks of the cores lie in one plane when installed.

In order to influence the magnetic field in a specific way, the ferromagnetic circuit is normally interrupted by spaces or air gaps, this being referred to as a "magnetic shear." A permanent magnet may also be located in such a space, making a further increase in the magnetic energy possible under specific conditions. The system of such air gaps and permanent magnets is preferably located at the joints between the I core and the O core.

A problem with the known devices for energy storage and energy transformation designed as ignition coils is that assembly gaps which are based on the manufacturing tolerances and the insertion play for inserting the I core into the O core must be maintained in the design of the magnetically active core elements. These gaps may be incompatible with the gap dimensions desired based on energy considerations.

Thus, for example, when a permanent magnet is positioned at one end area of the I core between the I core and the O core, no air gap is desired between the permanent magnet and the O core. The air gap that must be provided for manufacturing reasons must be compensated by appropriate measures or derivative actions, which are reflected in the overall dimensions and ultimately in additional costs as well.

It is therefore the object of the present invention to create a device for energy storage and energy transformation, in particular an ignition coil of an ignition system of a motor vehicle, having a magnetically active I core and a peripheral core surrounding a coil system, which in conjunction with the I core produces a magnetic circuit, it being possible to implement the transition between the I core and the peripheral core to be gap-free or having a gap size selected according to energy-related considerations.

SUMMARY OF THE INVENTION

A device for energy storage and energy transformation, in which the peripheral core has a recess for accommodating an end area of the I core in its circumferential extension, has the advantage that the I core which is preassembled with the coil formers may be inserted into the peripheral core without axial assembly gaps, making it possible to implement a magnetically active circuit which is nearly free from undesirable air gaps and makes it possible to efficiently utilize permanent magnets that may be provided.

This makes it possible to obtain improved electrical characteristics with the same overall dimensions or devices of smaller overall dimensions having comparable electrical characteristics may be implemented.

If no permanent magnet is provided on the I core in the area of the joint with the peripheral core, the design of the present invention may be used to implement a minimum air gap, which may be sized purely according to energy-related considerations without limitations resulting from manufacturing tolerances and assembly requirements In an advantageous embodiment of the present invention, the peripheral core may be of one-piece design, the connection between the I core and the peripheral core preferably being designed as a clamped joint in the area of its circumferential recess for accommodating the I core.

In a different design, the peripheral core may also be of a two-piece design, a separation preferably extending between the peripheral core parts in the area of a permanent magnet which is situated between the I core and the peripheral core in an end area of the I core, the permanent magnet facing away from the end area of the I core inserted into the peripheral core between the I core and the peripheral core. While in a clamped joint or press fit the circumferential ring is expanded when inserting the I core, this may be eliminated with complete preservation of function if the peripheral core is of two-piece design. In addition a design of the peripheral core having two core halves allows better nesting in a stamping die, thus resulting in lower material costs in manufacture.

The device for energy storage and energy transformation according to the present invention may be used for any desired purpose; however, it is suited in particular as an ignition coil of an ignition system of a motor vehicle. Its geometry may be adapted to the particular requirements and may be in the form of a pencil coil or compact coil.

DETAILED DESCRIPTION

Figure 1A:
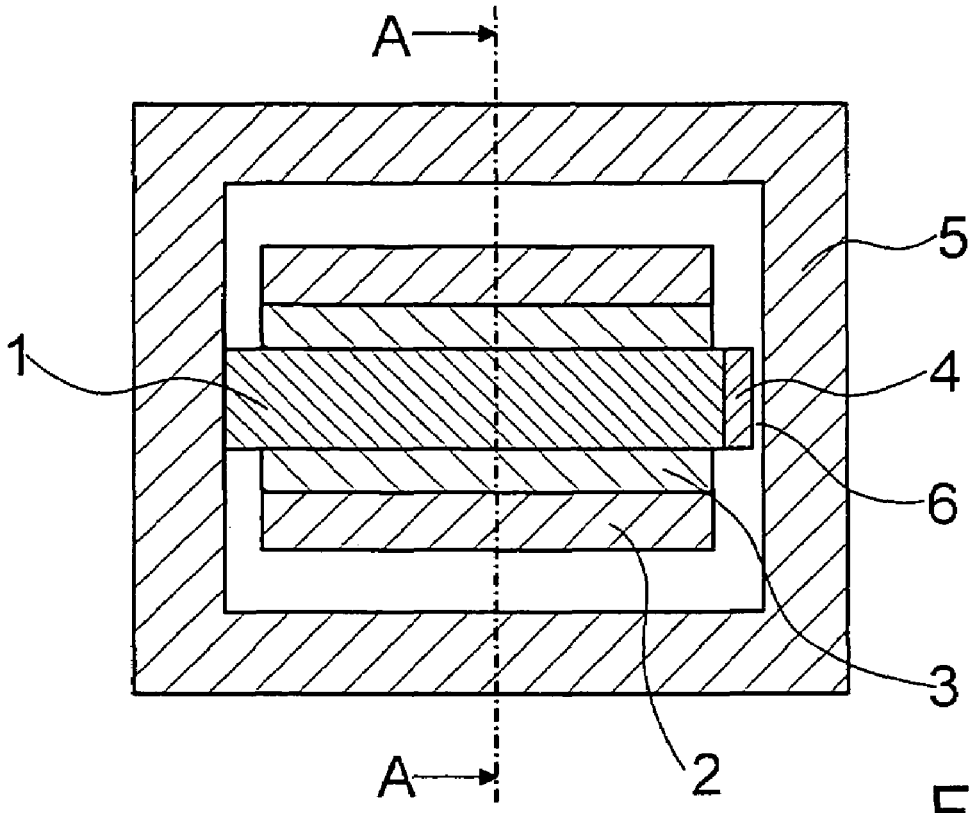
FIG. 1*a* shows a highly schematic longitudinal section through a system of coils and core elements of a known compact ignition coil.
Figure 1B:
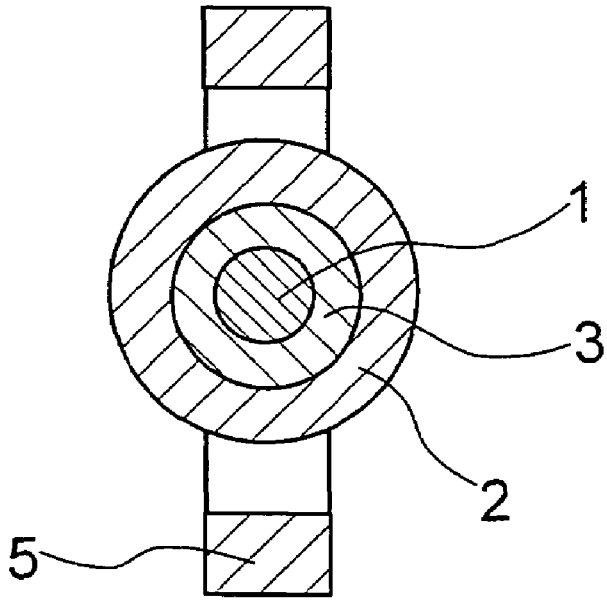
FIG. 1*b* shows a highly simplified section through the system according to FIG. 1*a* along line A—A in FIG. 1*a*.

In order to illustrate the present invention, FIGS. 1*a* and 1*b* first show in a highly schematic form the configuration of a known compact ignition coil, which has a centrally positioned magnetically soft I-core, which is constructed of layered electric sheet steel. A first coil former 2 is positioned concentrically surrounding the magnetically active I core, a winding connected to a supply voltage from a vehicle electrical system and used as a primary winding being applied to coil former 2.

Situated radially within first coil former 2, which represents an external coil former, is a second internal coil former 3, which also surrounds the I core and has a winding used as a secondary winding connected to a high-voltage terminal, which is connected to a spark plug in a manner not shown.

In one end area, magnetically soft I core 1 situated within coil formers 2 and 3 has a permanent magnet 4, which is connected to lamellar I core 1 in a manner known per se.

Departing from the embodiment shown, providing a permanent magnet at both ends of the I core is also known.

Together with coil formers 2 and 3, I core 1 is inserted as a preassembled module into peripheral core 5 which surrounds the entire longitudinal extent of the entire system, peripheral core 5, like I core 1, being constructed of stacked lamellar electric sheet steel. An assembly gap 6 that compensates for manufacturing tolerances is situated between permanent magnet 4 and adjacent peripheral core 5, the assembly gap, however, being disadvantageous from the energetic point of view.

In contrast to FIGS. 1*a* and 1*b*, FIGS. 2 and 3 show a system of an I core 1, a peripheral core 5 and a system of coil formers 2 and 3 having a similar function as the components provided with the same reference numerals of FIGS. 1*a* and 1*b*, peripheral core 5 of the present invention having, however, a recess 7 in its circumferential extension, which accommodates an end area of I core 1.

Figure 2:
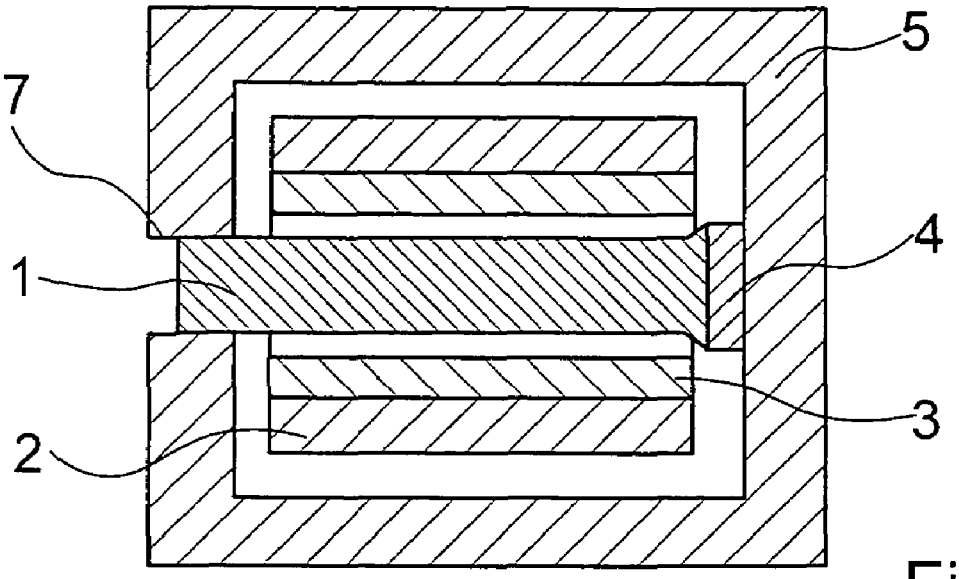
FIG. 2 shows a highly simplified longitudinal section through a first exemplary embodiment according to the present invention of a system of coil formers, an I core, and a peripheral core of a compact ignition coil.
Figure 3:
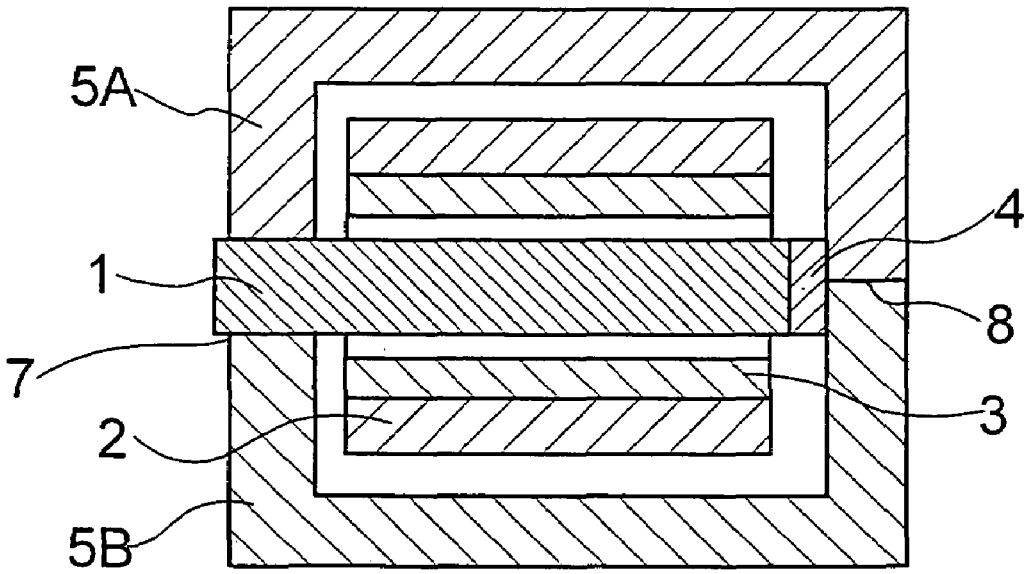
FIG. 3 shows a highly simplified longitudinal section through a second exemplary embodiment according to the present invention of a system of coil formers, an I core and a peripheral core of a compact ignition coil.

In the two exemplary embodiments shown in FIG. 2 and FIG. 3, a permanent magnet 4 is positioned in an end area of I core 1, which faces away from the end area inserted in recess 7 of peripheral core 5, permanent magnet 4 being directly adjacent to peripheral core 7, the I core including permanent magnet 4 always being inserted into peripheral core 5 in such a manner that an air gap is avoided between permanent magnet 4 and peripheral core 5.

An embodiment variant is shown in FIG. 2 in which peripheral core 5 is of one-piece design and a clamped joint or press fit with the I core is formed in the area of recess 7. Peripheral core 5 is designed in such a way that recess 7 in the unassembled condition has a smaller size than the accommodating end area of I core 1 and is widenable, the widenability of peripheral core 5 or of recess 7 being selected so that the preassembled module of I core 1, permanent magnet 4 and core formers 2 and 3 may be inserted into peripheral core 5 without difficulty and is clamped to the corresponding end area of I core 1 after the widening of peripheral core 5 or of recess 7 is relieved.

This ensures contact and direct magnetic connection between I core 1 and peripheral core 5. The attractive force of permanent magnet 4 ensures direct connection between I core 1 and peripheral core 5 at the diametrically opposed joint.

In the embodiment according to FIG. 3, peripheral core 5 is of two-piece design including a first core half 5A and a second core half 5B, a point of separation 8 extending between I core 1 and peripheral core 5 in the area of contact between permanent magnet 4 and peripheral core 5. At the opposite end area of I core 1, the latter is again accommodated in recess 7 of peripheral core 5; in this case also, it is possible to select I core 1 to be of any length, and it is ensured that an adequate connection exists between I core 1 and peripheral core 5 in the installed condition.

Any air gap that may be present between I core 1 and peripheral core 5 in the area of recess 7 may be closed by the force of permanent magnet 4 in the embodiment according to FIG. 3.

What is claimed is:

1. A device for energy storage and energy transformation, comprising:

a first coil former having a winding for connection to a supply voltage;

a second coil former having a winding for connection to a high-voltage terminal;

a magnetically active I core surrounded by the first coil former and the second coil former; and a peripheral core forming a magnetic circuit with the I core and enclosing a system including the first coil former and the second coil former;

a permanent magnet positioned at a joint between the I core and the peripheral core;

a clamped joint existing between the peripheral core and the I core, wherein;

the peripheral core includes a through-recess in a circumferential extension thereof to accommodate an end area of the I core;

the permanent magnet is positioned at an end area of the I core facing away from the end area inserted into the through-recess of the peripheral core;

the permanent magnet is directly adjacent to the peripheral core;

the peripheral core is in one piece; and the through-recess in an unassembled condition has a smaller size than the end area of the I core to be accommodated therein and is widenable to accommodate the end area of the I core.

2. The device as recited in claim 1, wherein:

the device is an ignition coil of an ignition system of a motor vehicle.

3. The device as recited in claim 1, wherein:

the first coil former is an external coil former concentrically surrounding the I core, and the second coil former is an internal coil former concentrically surrounded by the external coil former.

4. The device as recited in claim 1, wherein:

the I core, the first coil former, the second coil former, and the permanent magnet form a preassembled module when the I core is inserted into the through-recess of the peripheral core.

5. The device as recited in claim 1, wherein:

at least one of the I core and the peripheral core includes iron as a magnetically active material.

6. The device as recited in claim 5, wherein:

the magnetically active material includes layered lamellae.

7. A device for energy storage and energy transformation, comprising:

a first coil former having a winding for connection to a supply voltage;

a second coil former having a winding for connection to a high-voltage terminal;

a magnetically active I core surrounded by the first coil former and the second coil former;

a peripheral core forming a magnetic circuit with the I core and enclosing a system including the first coil former and the second coil former; and a permanent magnet positioned at a joint between the I core and the peripheral core, wherein:

the peripheral core includes a through-recess in a circumferential extension thereof to accommodate an end area of the I core;

the permanent magnet, the I core, and the peripheral core are dimensioned in such a way that an air gap that may exist between the I core and the peripheral core is closed by magnetic force in an area of the through-recess provided for accommodating the I core;

the permanent magnet is positioned at an end area of the I core facing away from the end area inserted into the through-recess of the peripheral core, the permanent magnet is directly adjacent to the peripheral core;

the peripheral core is of a two-piece design including a first peripheral core part and a second peripheral core part, and a separation extends between the first peripheral core part and the second peripheral core part in an area of contact of the permanent magnet.

8. The device as recited in claim 7, wherein:

the device is an ignition coil of an ignition system of a motor vehicle.

9. The device as recited in claim 7, wherein:

the first coil former is an external coil former concentrically surrounding the I core, and the second coil former is an internal coil former concentrically surrounded by the external coil former.

10. The device as recited in claim 7, wherein:

the I core, the first coil former, the second coil former, and the permanent magnet form a preassembled module when the I core is inserted into the through-recess of the peripheral core.

11. The device as recited in claim 7, wherein:

at least one of the I core and the peripheral core includes iron as a magnetically active material.

12. The device as recited in claim 11, wherein:

the magnetically active material includes layered lamellae.

* * * * *